US007365481B2

(12) United States Patent
Kawase et al.

(10) Patent No.: US 7,365,481 B2
(45) Date of Patent: Apr. 29, 2008

(54) FIELD EMISSION DEVICE WITH CHANGE IN EMISSION PROPERTY

(75) Inventors: Toru Kawase, Katano (JP); Keisuke Koga, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/316,374

(22) Filed: Dec. 10, 2002

(65) Prior Publication Data

US 2003/0107312 A1 Jun. 12, 2003

(30) Foreign Application Priority Data

Dec. 10, 2001 (JP) ..... 2001-375404

(51) Int. Cl.
*H01J 1/62* (2006.01)
*H01J 63/04* (2006.01)

(52) U.S. Cl. ..... 313/495; 313/309; 313/310; 313/336; 313/351

(58) Field of Classification Search ..... 313/495–496, 313/309–310, 336, 351, 346 R; 315/169.1, 315/169.3

See application file for complete search history.

(56) References Cited

U.S. PATENT DOCUMENTS

| | | | | |
|---|---|---|---|---|
| 4,063,128 | A | 12/1977 | Hughes | 313/409 |
| 4,298,818 | A | 11/1981 | McCandless | 313/417 |
| 4,736,133 | A | 4/1988 | Barbin et al. | 313/414 |
| 5,122,135 | A | 6/1992 | Dürr et al. | 606/4 |
| 5,336,973 | A | 8/1994 | Leroux et al. | 315/14 |
| 5,592,056 | A * | 1/1997 | Peyre et al. | 315/169.1 |
| 5,604,401 | A | 2/1997 | Makishima | 315/3 |
| 5,808,401 | A * | 9/1998 | Jin et al. | 313/309 |
| 5,874,802 | A | 2/1999 | Choi et al. | 313/495 |
| 5,898,183 | A | 4/1999 | Teder | 250/574 |
| 5,981,303 | A * | 11/1999 | Gilton | 438/20 |
| 6,040,973 | A * | 3/2000 | Okamoto et al. | 361/235 |
| 6,313,815 | B1 | 11/2001 | Takeda et al. | 345/75.2 |
| 6,394,871 | B2 * | 5/2002 | Lee | 445/24 |
| 6,417,016 | B1 * | 7/2002 | Gilton et al. | 438/20 |
| 6,664,727 | B2 * | 12/2003 | Nakamoto | 313/495 |
| 6,677,706 | B1 * | 1/2004 | Hara et al. | 313/496 |
| 6,741,019 | B1 * | 5/2004 | Filas et al. | 313/355 |
| 6,822,379 | B2 * | 11/2004 | McClelland et al. | 313/309 |
| 6,847,338 | B2 * | 1/2005 | Abe et al. | 345/60 |

FOREIGN PATENT DOCUMENTS

| | | |
|---|---|---|
| JP | 48-90467 | 11/1973 |
| JP | 5-12986 | 1/1993 |
| JP | 7-182968 | 7/1995 |
| JP | 9-204880 | 8/1997 |
| JP | 9-288961 | 11/1997 |

* cited by examiner

*Primary Examiner*—Joseph L. Williams
*Assistant Examiner*—Kevin Quarterman
(74) *Attorney, Agent, or Firm*—Hamre, Schumann, Mueller & Larson, P.C.

(57) ABSTRACT

A field emission device having cold cathode devices including an emitter and a lead electrode, and the field emission device is provided with the plural kinds of cold cathode device groups classified based on the emission property of the cold cathode device. This field emission device has a member for allowing the cold cathode device group to perform emission by successively changing the cold cathode device group that mainly performs emission based on the difference in the emission property. Thus, it is possible to maintain the emission current at a predetermined necessary value or more and to realize the long lifetime of the field emission device.

27 Claims, 9 Drawing Sheets

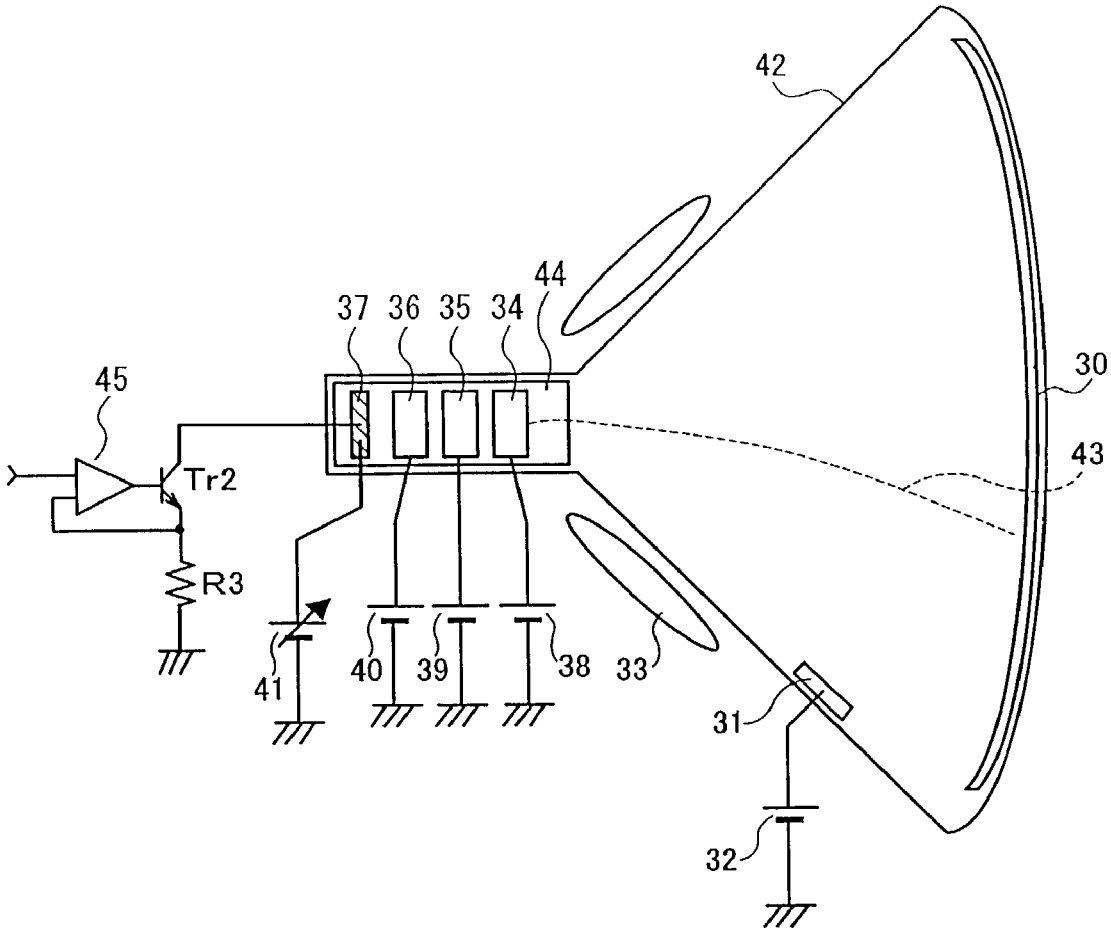
FIG. 13
FIG. 14
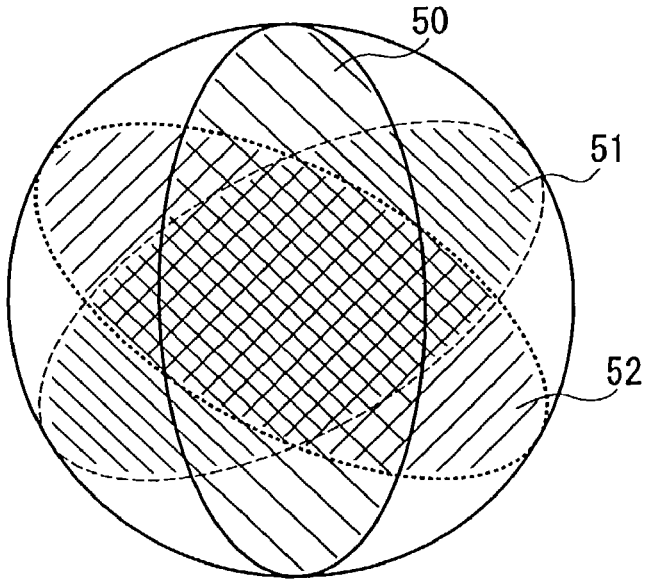

FIELD EMISSION DEVICE WITH CHANGE IN EMISSION PROPERTY

BACKGROUND OF THE INVENTION

1. Field of the Invention

The present invention relates to a field emission device used for a display, an electron beam exposure apparatus using converged electron beams, and the like.

2. Related Background Art

A field emission type cold cathode device (hereinafter "field emission device" will be referred to) is expected to be applied for various kinds of electronics such as an image display apparatus, an electron microscope, an electron beam exposure apparatus, and the like. In these apparatuses, even after sale, it is necessary to maintain the quality of products by prolonging the lifetime of the field emission device. However, since the field emission device generally has only one portion that causes emission (emits electrons), it was difficult to increase the lifetime of the device. Therefore, a large number of techniques for improving the lifetime of the device have been proposed. For example, JP 5 (1993)-12986A discloses a field emission device in which plural electron emission portions are electrically connected in series and the electron emission portions contributing to emission of electrons is changed by using a conductive member and heat.

FIG. 15 is a schematic view showing this field emission device. In FIG. 15, reference numerals 1 and 2 denote a cathode electrode and an anode electrode, respectively; 3 denotes a particulate film including an electron emission material; 4 denotes an insulating substrate; 5*a* denotes an electron emission portion; 6*a* denotes a phosphor target; 7 denotes a light emitting portion; and 8*a* denotes a conductive member. As shown herein, plural electron emission portions 5*a* are disposed between a pair of electrodes. In the vicinity of these electron emission portions 5*a*, conductive members 8*a* are disposed to form a field emission device. In this field emission device, the conductive member 8*a* is melted by heat supplied by irradiation with infrared rays to short-circuit the cathode electrode 1 and the anode electrode 2. Thus, the electron emission portion 5*a* is changed.

However, in this device, the electron emission portions 5*a* can be changed only in the manufacturing process. Therefore, if a problem occurs in the field emission device after products using this device come on the market, such a problem cannot be resolved appropriately. Consequently, it has not been possible to increase the lifetime of the device. Furthermore, in this device, also in the manufacturing process, since the electron emission portions 5*a* are connected in series, the number of components such as an electrode is increased, thereby prolonging the number of manufacturing steps and reducing the yield. Furthermore, when the electron emission portions are changed, in order to identify a defective part, a microscope, etc. is needed. Also, it is also necessary to supply heat successively from the outside by laser irradiation, etc. Thus, this device was inferior also in terms of the workability. Also, the productivity was reduced due to a so-called cycle time. Furthermore, the area occupied by the components other than the electron emission portions 5*a* increases, which may reduce the electron emission efficiency.

SUMMARY OF THE INVENTION

It is an object of the present invention to provide a field emission device that has a long lifetime.

The field emission device of the present invention has a cold cathode device including an emitter and a lead electrode. This field emission device has plural kinds of cold cathode device groups classified based on an emission property of the cold cathode device. Furthermore, this field emission device has a member for allowing the cold cathode device groups to carry out emission by successively changing the cold cathode device group that mainly performs emission based on a difference in the emission property.

According to this configuration, without carrying out specific operation from the outside, by successively changing the cold cathode device group to cause emission by, for example, prolonging the voltage applied to a lead electrode, the emission current can be maintained at a predetermined necessary value or higher and the lifetime of the field emission device can be increased.

BRIEF DESCRIPTION OF THE DRAWINGS

FIG. 13 is a cross-sectional view showing a picture tube according to a fifth embodiment of the present invention.

FIG. 14 is a plan view showing a field emission device according to a sixth embodiment of the present invention.

DETAILED DESCRIPTION OF THE INVENTION

First Embodiment

Figure 1:
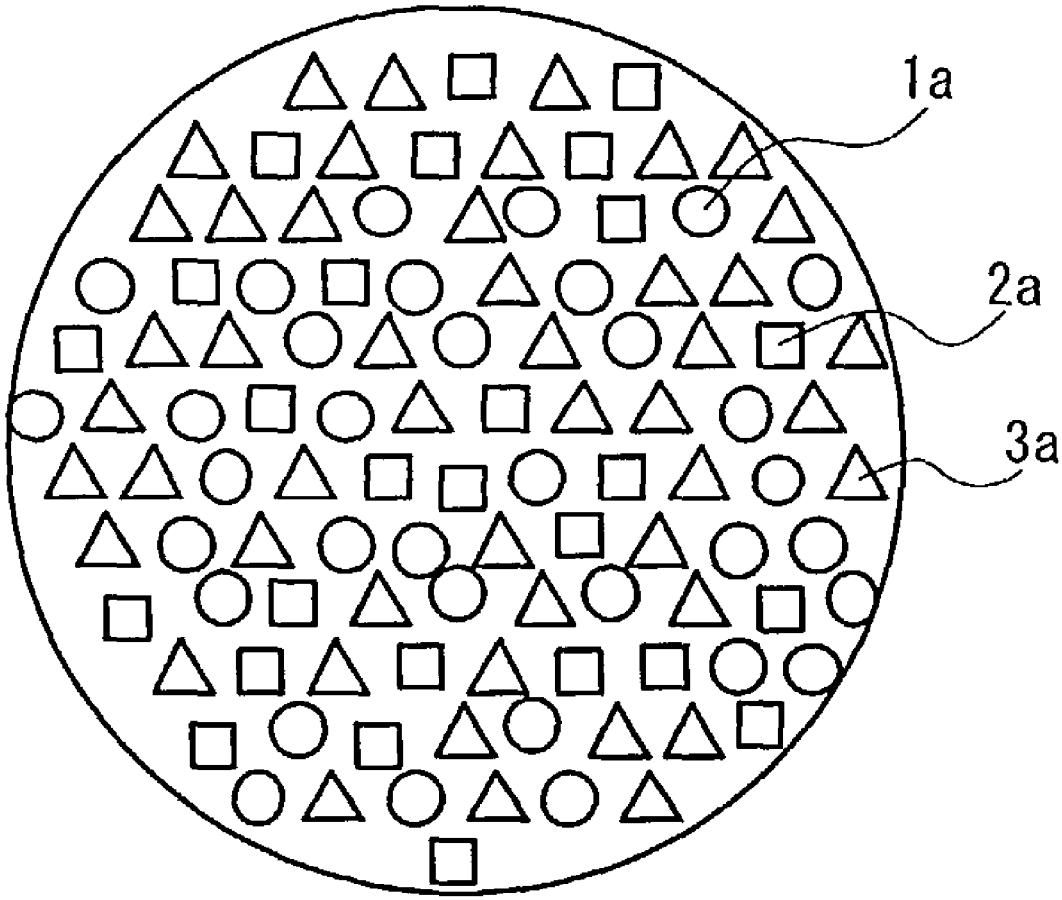
FIG. 1 is a plan view showing a cold cathode device according to a first embodiment of the present invention.

FIG. 1 is a plan view showing a field emission device according to this embodiment. As shown in FIG. 1, the cold cathode devices 1*a*, 2*a*, and 3*a* are distributed at random on the cathode electrode substantially without boundaries. Each cold cathode device is a single emitter or an emitter group in which plural emitters are gathered. Herein, cold cathode devices are disposed on the cathode electrode so that the cold cathode device having substantially the same emission property belongs to the same kind of group (cold cathode devices having substantially the same emission property are shown by marks ○, □, and Δ, respectively). The emission property is a property represented by a curve showing the relationship between the lead voltage and the emission current when the lead voltage is applied to each cold cathode device to cause emission. The property is characterized by the voltage from which each cold cathode electrode starts emission hereinafter, this voltage will be referred to as "threshold voltage"), the inclination and shape of the curve, and the like.

Figure 2:
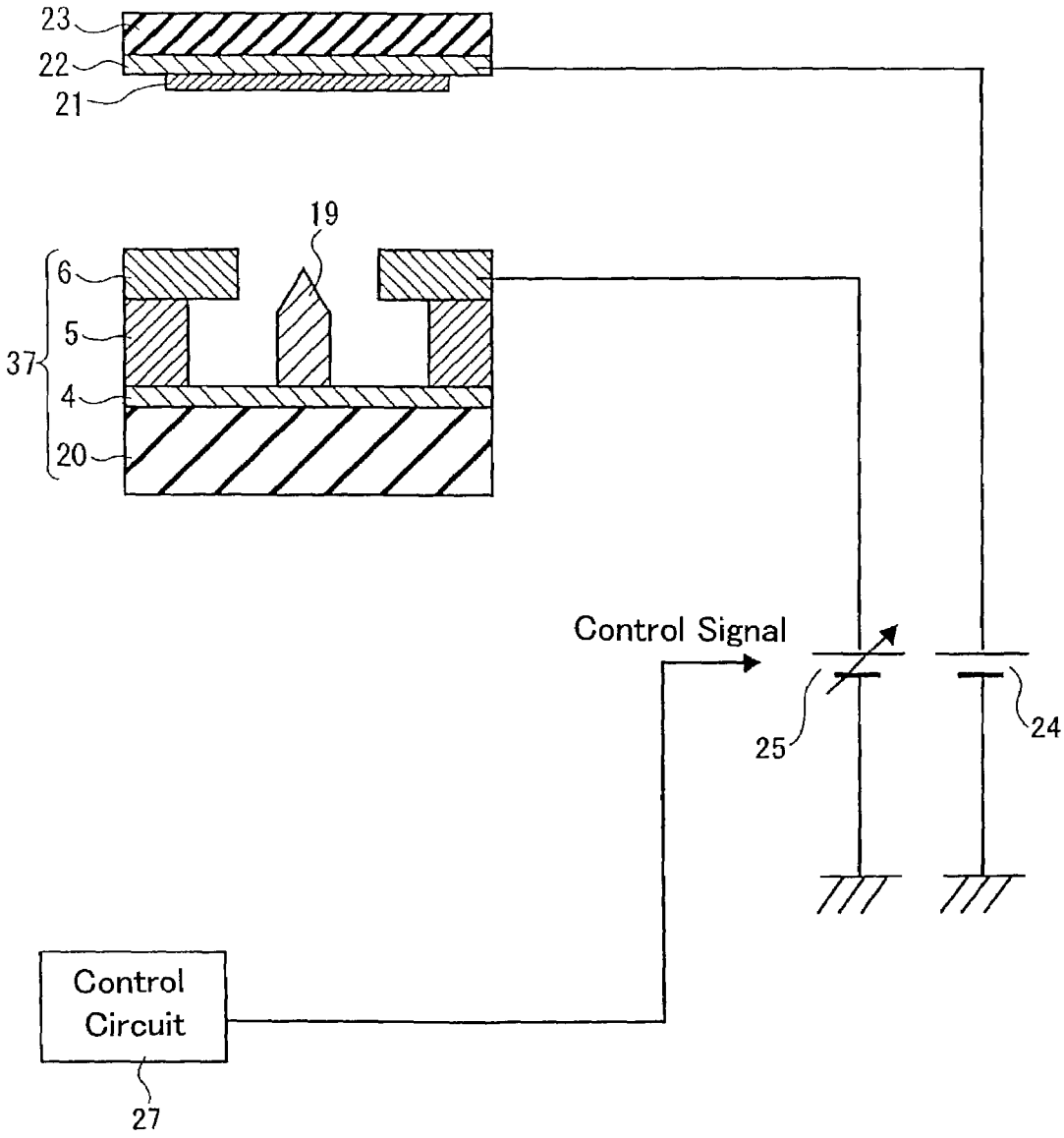
FIG. 2 is a cross-sectional view showing a schematic configuration of the field emission device according to the first embodiment.

Next, with reference to FIG. 2, the configuration and operation of the field emission device shown in FIG. 1 will be explained. A cold cathode device 37 that is a component unit of the field emission device includes an emitter 19 and a lead electrode 6. A substrate 23 provided with an anode electrode 22 on the surface thereof is disposed facing the cold cathode device 37.

On a substrate 20, a cathode electrode 4 is formed, and further on the cathode electrode 4, an insulating layer 5 is formed. On the insulating layer 5, the lead electrode 6 is formed. A space is defined by the insulating layer 5 and the lead electrode 6. In the space, the emitter 19 is disposed. On the anode electrode 22, a phosphor target 21 is formed facing the emitter 19. To the lead electrode 6, a lead power supply 25 is connected. To the anode electrode 22, an anode power supply 24 is connected and DC voltage is applied.

In this state, the lead voltage is increased by controlling the lead power supply 25 with a control circuit 27. When, the lead voltage exceeds the threshold voltage of the cold cathode device 37, the field emission device starts emission, and thus electrons are emitted from the emitter 19. The electrons emitted from the emitter 19 are accelerated in the direction of the anode electrode 22 by DC voltage applied to the anode electrode 22 and collides with the phosphor target 21, and thus light is emitted.

Figure 3:
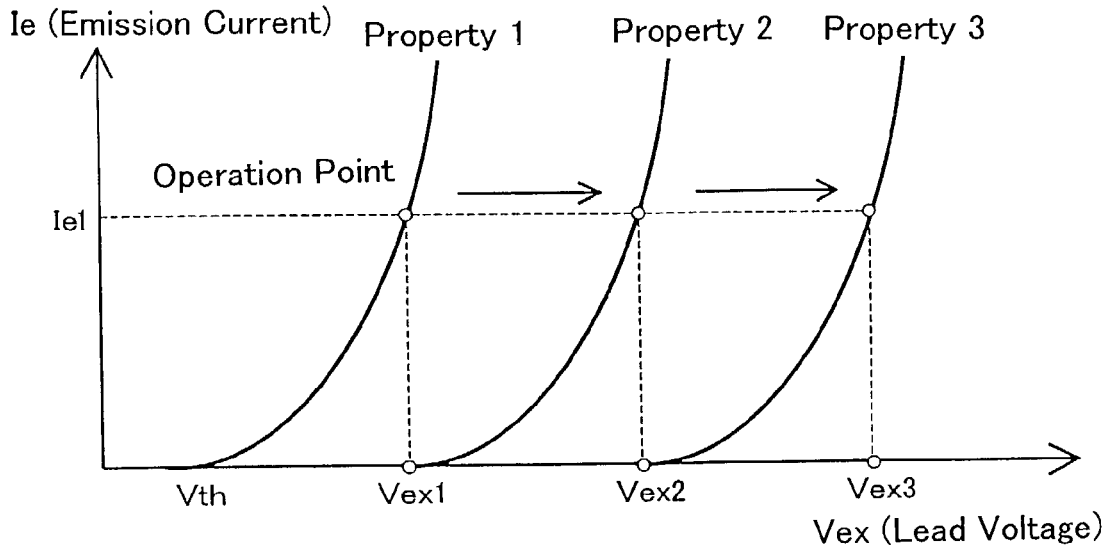
FIG. 3 is a graph showing the emission property of the cold cathode device according to the first embodiment.

FIG. 3 shows an emission property of the field emission device shown in FIG. 1. In the graph of FIG. 3, an axis of the abscissa shows emission current and an axis of the ordinate shows lead voltage applied to the lead power supply 25 for leading emission current. The emission property of the cold cathode device 1*a* is shown by a curve of the property 1. In the property 1, in order to secure the emission current at Ie1 or more, the lead voltage may be set to Vex 1 or more that is a threshold voltage. Furthermore, the emission properties of the cold cathode device 2*a* and the cold cathode device 3*a* are shown by a curve of the property 2 and a curve of the property 3, respectively. Each curve shows that the threshold voltages of the cold cathode devices 1*a* to 3*a* belonging to the respective cold cathode device group are different from each other.

Figure 4:
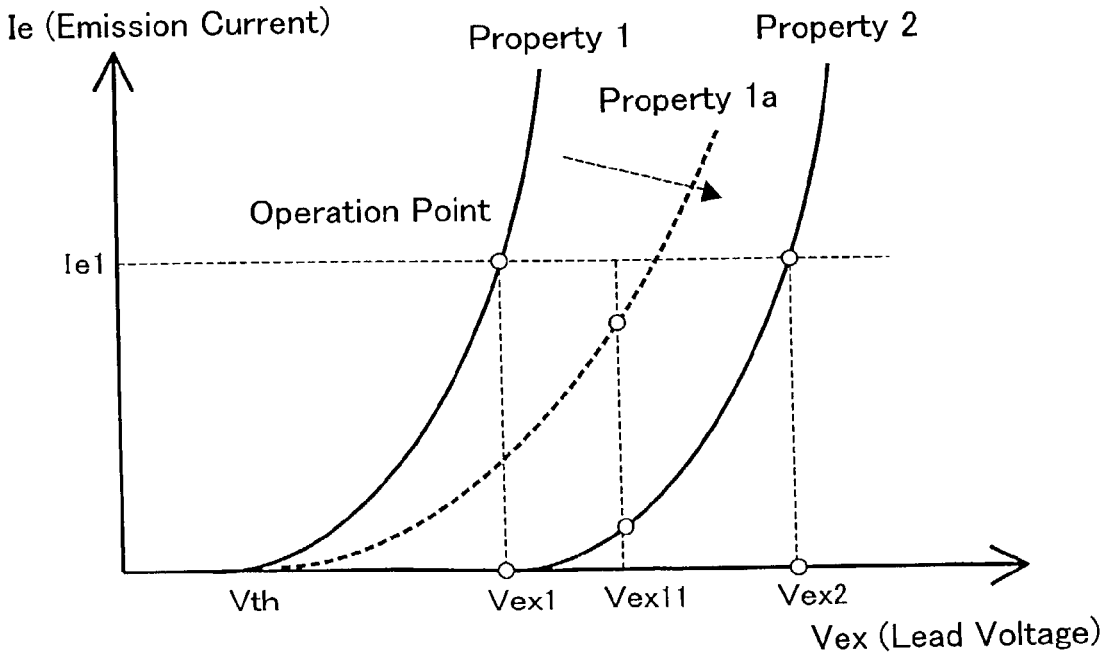
FIG. 4 is a graph showing a mechanism in which the emission current becomes constant in the cold cathode device according to the first embodiment.

Next, with reference to FIG. 4, the operation of the field emission device will be explained. At the starting point of the operation, when the lead voltage is set to Vex 1, a group including the cathode electrode device 1*a* having the property 1 mainly carries out emission and the current value Ie1 is secured. With the lapse of time, the group including the cold cathode device 1*a* deteriorates and the property 1 shifts to the property 1*a* of the curve shown by a broken line. At this time, since the emission current cannot be maintained at Ie1 or more at which emission occurs, the lead voltage is increased to Vex11. Accordingly, emission starts from the group including the cold cathode device 2*a* having the property 2, and the sum of the emission current from the group including the cold cathode device 1*a* and the group including the cold cathode device 2*a* becomes the total emission current.

Furthermore, when the deterioration of the group including the cold cathode device 1*a* having the property 1 advances and the emission hardly occurs from the group including the cold cathode device 1*a*, by increasing the lead voltage to Vex 2, the group including the cathode electrode device 2*a* having the property 2 mainly carries out emission and the emission current from the field emission device becomes Ie1 or more only from the group including the cold cathode 2*a*. Thus, even if the group including the cold cathode device 1*a* deteriorates, by increasing the lead voltage, it is possible to maintain the total emission current at Ie1 or more.

As mentioned above, even if one cold cathode device group having one emission property deteriorates, by increasing the lead voltage, the cold cathode device group that mainly performs emission can be changed successively. Thus, it is possible to maintain the emission current at Ie1 at which emission occurs, or more.

Figure 5:
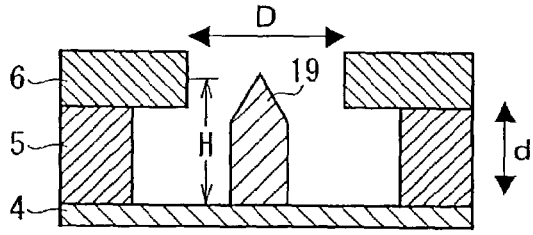
FIG. 5 is a cross-sectional view showing a cold cathode device according to the first embodiment.
Figure 6:
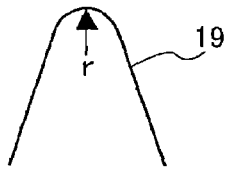
FIG. 6 is an expanded view showing a tip of the emitter in the cold cathode device according to the first embodiment.

The emission property of each cold cathode device group can be changed by varying any of the dimensions of a thickness d (μm) of the insulating layer 5, a diameter D (μm) of the open part, and the height H (μm) of the emitter 19 shown in FIG. 5 in the cold cathode device belonging to each cold cathode device group. Furthermore, the emission property can be changed also by varying the radius of curvature r of the tip of the emitter 19 shown in FIG. 6.

Figure 7:
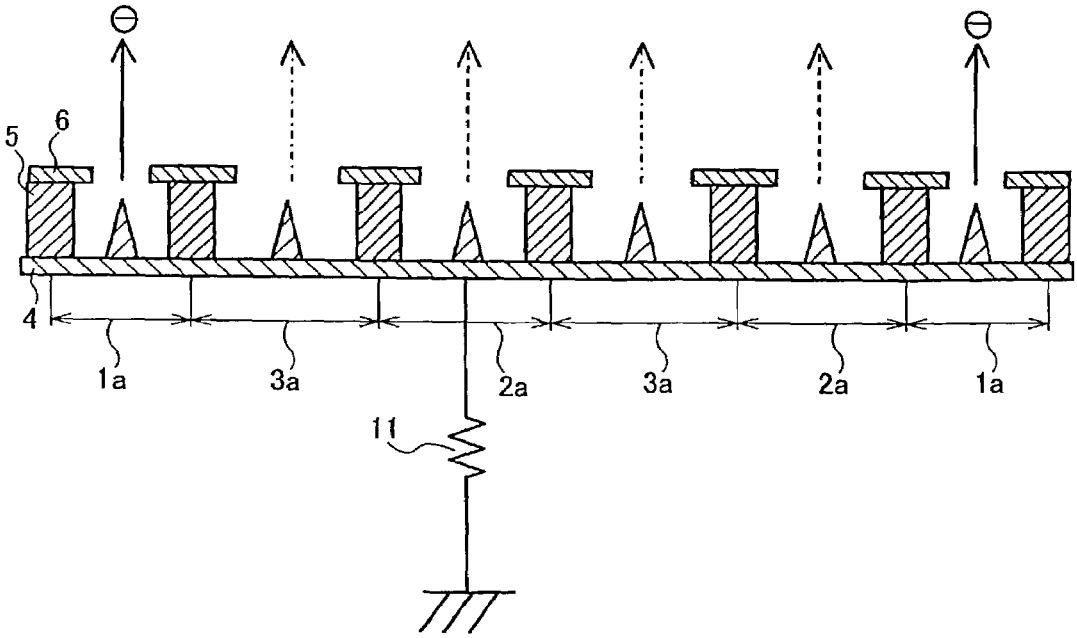
FIG. 7 is a cross-sectional view showing an electron emission device according to the first embodiment.

FIG. 7 is a cross-sectional view showing the field emission device shown in FIG. 1. Thus, all of the cold cathode devices 1*a* to 3*a* have an open part having substantially the same diameter D (μm), forming respective groups on the cathode electrode 4. For example, when the diameter D of the cold cathode devices 1*a*, 2*a*, and 3*a* are set to 2.0 μm, 3.0 μm, and 4.0 μm, respectively, three kinds of cold cathode device groups having the threshold voltages Vth=40V, Vex1=60V, and Vex2=80V are formed on the cathode electrode 4 in accordance with the values of the diameter D. To the cathode electrode 4, grounded limiting resistance 11 is connected.

According to this embodiment, the field emission device has plural kinds of cold cathode devices groups including the cold cathode devices having substantially the same emission property. Therefore, even if one cold cathode device group having one emission property deteriorates over time, by increasing the lead voltage and successively changing the cold cathode device groups having different kinds of emission properties so as to start emission, the emission current can be maintained at a predetermined value that is necessary to start emission in the field emission device, or more, and the long lifetime of the field emission device can be realized.

Furthermore, according to this embodiment, the cold cathode device groups can be changed only by increasing the lead voltage, therefore, the electric products provided with the field emission device of this embodiment has an increased lifetime with only a simple operation even after they are brought onto the market.

Furthermore, according to this embodiment, since the lead electrodes are electrically joined to each other, the cold cathode device group that performs emission can be changed successively by only increasing a single lead voltage applied to the lead electrode.

Note here that in this embodiment three kinds of cold cathode device groups are formed. It is possible to further increase the lifetime of the field emission device by forming four cold cathode devices or more.

Second Embodiment

Figure 8:
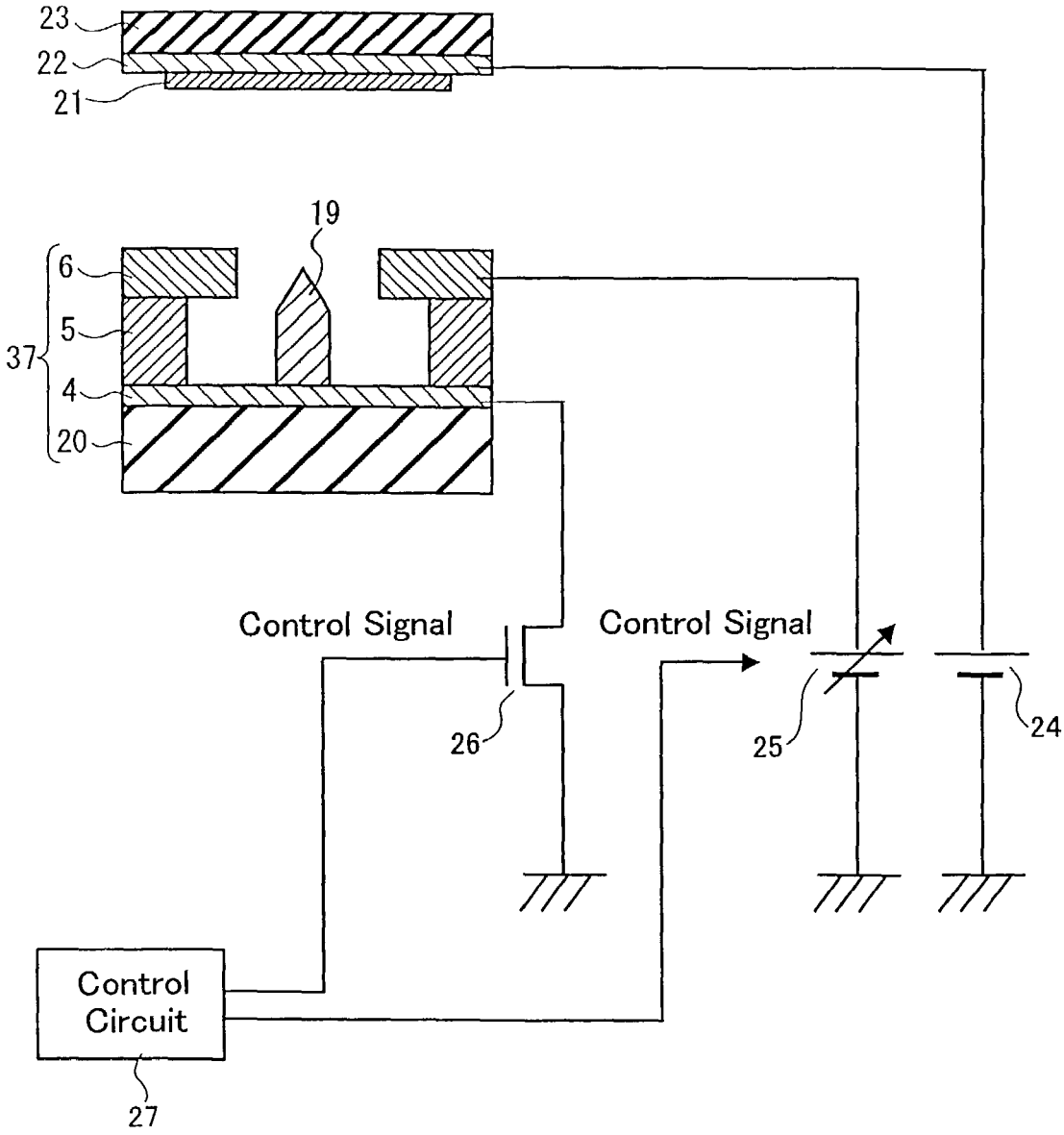
FIG. 8 is a cross-sectional view showing a schematic configuration of a field emission device according to a second embodiment of the present invention.

With reference to FIG. 8, the components of the field emission device and an example of a controlling method thereof will be explained. In this field emission device, a current control device 26 is connected to a cathode electrode 4. By inputting a control signal into the current control device 26 from the control circuit 27, the current flowing into the cathode electrode 4 is adjusted to control the amount of the emission current emitted from the emitter 19. The other components are the same as in the first embodiment. Herein, for the current control portion 26, an FET (Field Effect Transistor) is used and it is preferably used in the saturation range.

Figure 9:
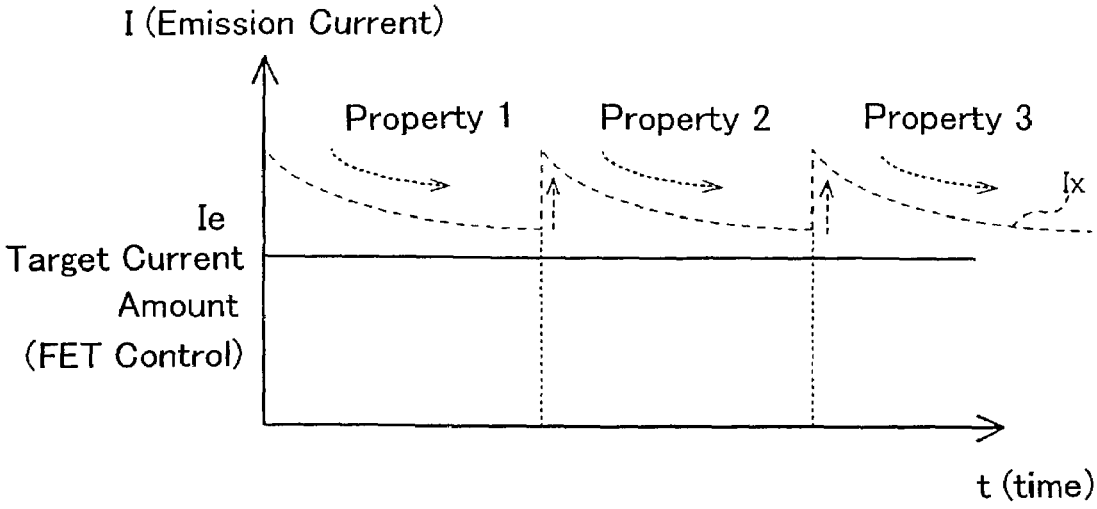
FIG. 9 is a graph showing a state in which a cold cathode device is controlled in the second embodiment.

With reference to FIG. 9, the control of the current flowing into the cathode electrode 4 will be explained. In a graph of FIG. 9, an axis of the abscissa shows emission current and an axis of the ordinate shows the time after emission starts. A broken line in FIG. 9 shows an emission limiting current Ix. When the emission current exceeds the emission limiting current Ix, the emission current changes over time. At the initial time of the emission, the cold cathode device 1*a* having the property 1 mainly operates. At this time, the emission current is controlled to a target current amount Ie at the emission limiting current Ix or less by the current control device 26. Next, when the group including the cold cathode 1*a* deteriorates over time and the emission current is lowered, the lead voltage is increased to operate mainly the group including the cold cathode device 2*a*. At this time, the control that is the same as mentioned above will be carried out. Furthermore, when the group including the cold cathode device 2*a* deteriorates over time and the emission current is lowered, the lead voltage is increased to operate mainly the group including the cold cathode device 3*a*. At this time, the operation same as mentioned above will be carried out.

According to this embodiment, the same effect as in the first embodiment can be obtained, and further the emission current is controlled at the emission limiting current or less by the current control device 26. Therefore, it is possible to suppress the change of the emission current over time and to make it stable.

Third Embodiment

Figure 10:
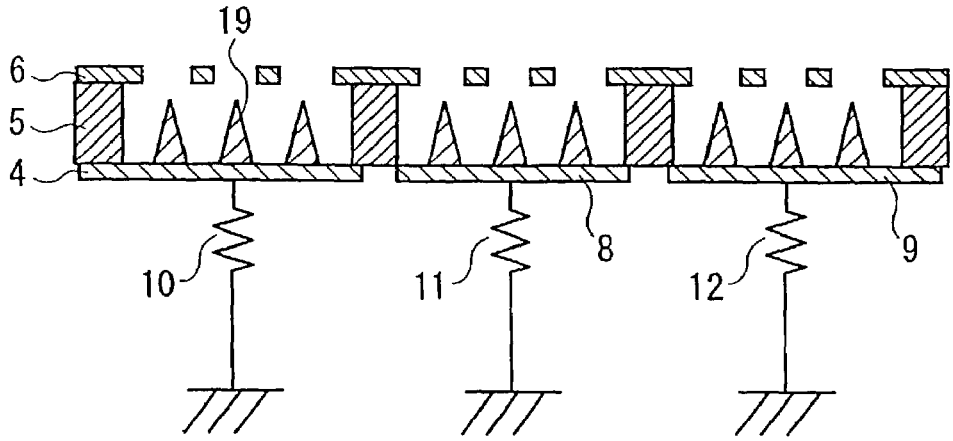
FIG. 10 is a cross-sectional view showing a field emission device according to a third embodiment of the present invention.

FIG. 10 is a cross-sectional view showing a field emission device according to this embodiment. In this field emission device, the cathode electrode 4 connected to the group including the cold cathode device 1*a* is electrically separated from the cathode electrodes 8 and 9, which are respectively connected to the groups including the other cold cathode devices 2*a* and 3*a*. Furthermore, limiting resisters 10, 11, and 12 are connected to the cathode electrodes 4, 8, and 9, respectively. The other components are the same as in the first embodiment.

Figure 11:
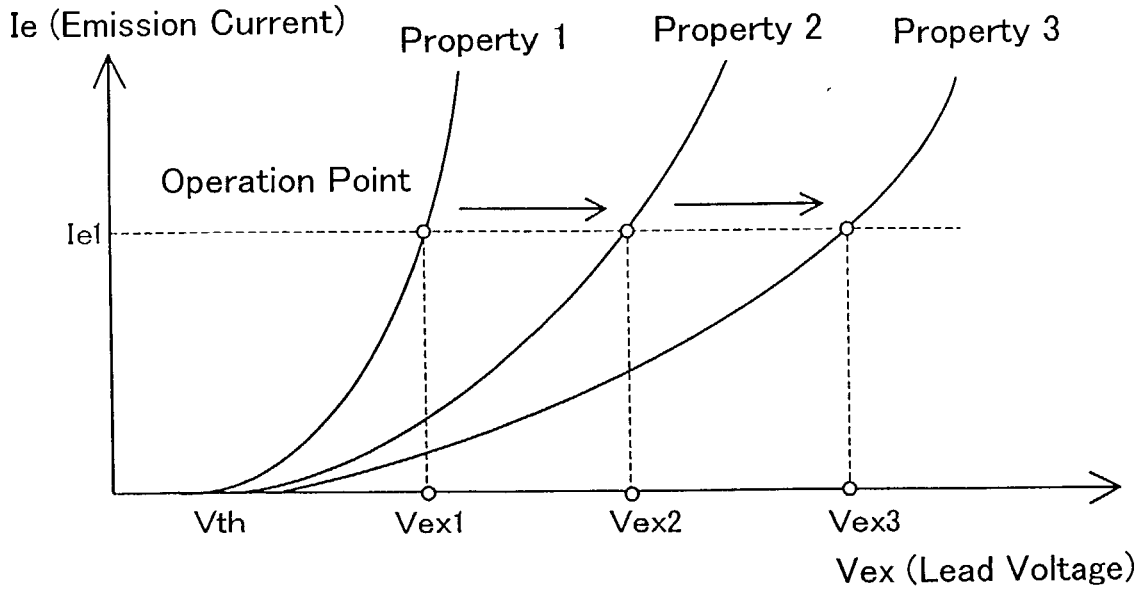
FIG. 11 is a graph showing the emission property of the cold cathode device according to the third embodiment.

In the field emission device of this embodiment, as shown in FIG. 11, the cold cathode device groups including the cold cathode devices having the emission properties 1 to 3, in which the threshold values are substantially the same and inclinations and shapes are different, are formed. Such emission properties were realized by varying the limiting resistance values connected to the cathode electrodes 4, 8, and 9.

With reference to FIG. 11, the operation of this field emission device will be explained. At the initial time of the operation, when the lead voltage is set to Vex1, the group including the cold cathode device 1*a* mainly performs emission, and thus the current value Ie1 is secured. That is, when the lead voltage is Vex1, the sum of the emission current of the groups including the cold cathode devices 1*a*, 2*a*, and 3*a* flows and the current value of Ie1 or more is secured. With the lapse of time, when the cold cathode device 1*a* deteriorates and the emission current cannot be maintained at Ie1 or more, the lead voltage is increased to Vex2. Thus, the group including the cold cathode device 2*a* mainly carries out emission and the sum of the emission current of the group including the cathode device 2*a* and the group including the cathode device 3*a* becomes the total emission current. Thus, even if the cold cathode device 1*a* deteriorates, by increasing the lead voltage, emission is performed successively from the groups including the cold cathode devices 2*a* and 3*a*, respectively. Thus, it is possible to maintain the total emission current at Ie1 or more.

According to this embodiment, even if one cold cathode device group deteriorates, by increasing the lead voltage, the emission current can be maintained at a predetermined value or more that is necessary to start emission and the long lifetime of the field emission device can be realized.

According to this embodiment, in the field emission device, by varying the value of the limiting resistance connected to each cold cathode device group, it is possible to form the cold cathode device group having the intrinsic emission property. And, even if one cold cathode device group deteriorates over time, by prolonging the lead voltage to change the cold cathode device groups successively and to start emission, the emission current can be maintained at a predetermined necessary value or more, realizing the long lifetime of the field emission device.

Note here that in this embodiment, the liming resistance is connected to the cathode electrode from the outside. For example, in the case where a Si substrate is used for the substrate of cold cathode device, the limiting resistance portion may be formed in the substrate portion of each cold cathode device group by doping, etc. so as to vary the limiting resistance value of the cathode electrode by so-called doping control.

Furthermore, instead of varying the limiting resistance, materials used for the emitter or materials to be coated on the tip of the emitter may be changed so as to vary the work function or resistance value of the emitter itself, the unique emission property can be provided to the cold cathode device group, and thus the same effect as mentioned above can be obtained.

Fourth Embodiment

Figure 12A:
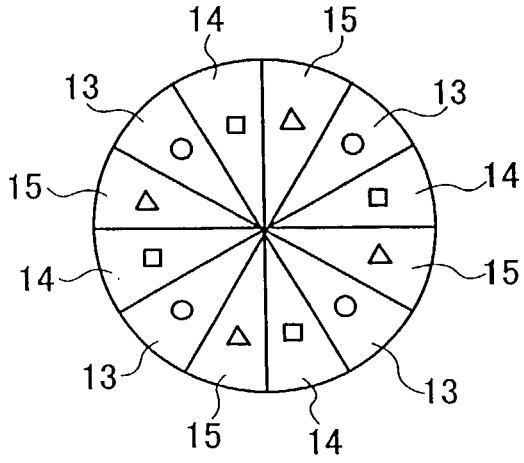
FIG. 12A is a plan view showing a cold cathode device classified in regions formed by radial boundaries.
Figure 12B:
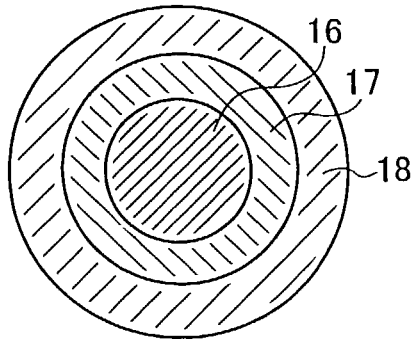
FIG. 12B is a plan view showing a cold cathode device classified in regions formed by concentric boundaries, respectively according to a fourth embodiment of the present invention.
Figure 15:
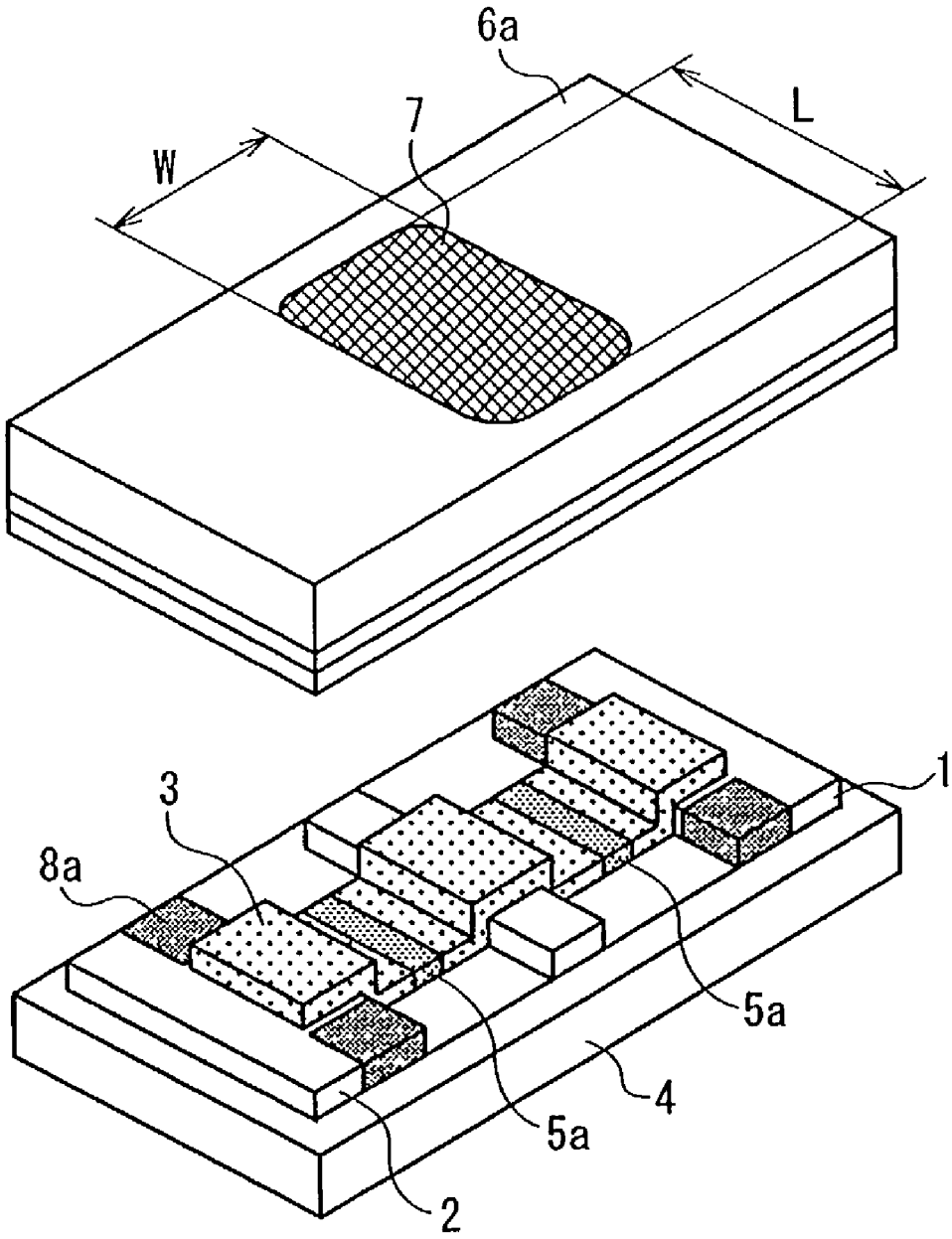
FIG. 15 PRIOR ART
FIG. 15 is a view showing a configuration of a field emission device of the prior art.

FIG. 12 is a plan view showing a cold cathode device according to this embodiment. The components of the field emission device of this embodiment are the same as the components of that in the first embodiment except that the cold cathode electrode groups each having the intrinsic emission property are classified in plural regions so that the emitted emission beams are disposed symmetrically with respect to a point at the center of the field emission device. FIG. 12A shows the case where the cold cathode device groups are classified in the regions formed by the radial boundaries; and FIG. 12B shows the case where the cold cathode device groups are classified in the regions formed by the concentric boundaries.

As shown in FIG. 12A, the regions 13, 14, and 15 respectively including the cold cathode devices 1*a*, 2*a*, and 3*a* are disposed alternately in this order. Furthermore, as shown in FIG. 12B, around the circular region 16 in which the group including the cold cathode device 1*a* is disposed, circular regions 17 and 18 in which the groups including cold cathode devices 2*a* and 3*a* are disposed respectively, are disposed in this order.

According to this configuration, the symmetry of the emission beams emitted from the field emission device can be secured, and further the control property and the converging property can be improved.

Note here that the shape of the boundary that forms regions is radial shape and concentric shape. However, any other shapes can be employed as long as the emitted emission beam can be secured to be disposed symmetrically with respect to a point. For example, the shape may be a grid shape or a helix shape.

Fifth Embodiment

In this embodiment, the application example of the field emission device according to the first to fourth embodiments as mentioned above will be explained.

FIG. 13 is a cross-sectional view showing a picture tube according to this embodiment. Reference numeral 37 denotes a cold cathode device. To a lead electrode of the cold cathode device 37, a lead power supply 41 is connected. To a cathode electrode of the cold cathode device 37, a source of a transistor Tr2 is connected. To a drain of the transistor Tr2, a resistor R3 is connected. To a gate of the transistor Tr2, an output of an operation amplifier 45 is connected in which a video signal input line and the drain of the transistor Tr2 are connected to the side of an input thereof. An electron emitted from the cold cathode device 37 is converged and accelerated in a first electrode 36, a second electrode 35, and a third electrode 34, which constitute an electron gun 44, in the cathode ray tube 42 and becomes an electron beam. The electron beam 43 is deflected by a deflection coil 33 and collides with a phosphor disposed at the predetermined position on a phosphor surface 30. Then, the electron derived from the electron beam passes through an anode terminal 31 that is electrically connected to the phosphor and flows into an anode power supply 32.

Herein, a positive voltage is applied to the first electrode 36, the second electrode 35, and the third electrode 34, by a first power supply 40, a second power supply 39, and a third power supply 38. Note here that the picture signal is input into the cold cathode device 37 by way of an operational amplifier 45.

According to this embodiment, by applying the field emission devices of the first to fourth embodiments as mentioned above to the picture tube, it is possible to provide a picture tube that realizes the long lifetime of the field emission device. Furthermore, as shown in the second embodiment, by connecting the current control device to the cathode electrode of the field emission device, the emission current becomes stable and electron beams with excellent precision can be obtained. Thus, the high quality image can be obtained.

Note here this embodiment is an example in which the electron emission device is applied to the picture tube. However, the electron emission device of the present invention can be applied to the other apparatuses such as an electron beam apparatus, a light source apparatus, and a discharge tube. Furthermore, by using the picture tube of this embodiment, a larger-size picture tube system can be configured.

Sixth Embodiment

This embodiment shows an example of the field emission device applicable to the picture tube mentioned in the fifth embodiment.

FIG. 14 is a schematic view showing the electron emission device according to this embodiment. The groups including the cold cathode devices 1*a*, 2*a*, and 3*a* having the different emission properties are disposed separately in the regions 50, 51, and 52, respectively. Note here that in the region in which respective regions are overlapped with each other, the cold emission devices 1*a*, 2*a*, and 3*a* belonging to the respective regions are uniformly disposed.

In this embodiment, in the respective regions 50, 51, and 52 are changed by the deflection position of the picture tube in order to cancel the distortion in the shape of the beam spot of the emitted emission beams on the screen surface.

According to this configuration, it is possible to minimize the distortion in the shape of the beam spot, which is generated when the beam is deflected and reaches the corner portion of the phosphor surface, and to provide a picture tube with high resolution.

Note here that each region is not necessarily disposed as shown in FIG. 14 and may be disposed in the other way as long as the distortion of the shape of the beam spot can be corrected.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A field emission device comprising:

a plurality of cold cathode device groups each comprising a plurality of cold cathode devices having substantially equal emission properties;

a lead electrode included in the cold cathode devices;

a power source that applies a voltage to the lead electrode included in the cold cathode devices; and a control member that increases the voltage to a predetermined voltage corresponding to the emission properties of one of the cold cathode device groups in order to select one of the cold cathode device groups that mainly performs emission, wherein the emission properties of the cold cathode devices include in one of the cold cathode device groups is different from the emission properties of the cold cathode devices included in another cold cathode device group.

2. A field emission device according to claim 1, wherein the emission property of each cold cathode device is changed by varying a diameter of an open part formed by the lead electrode.

3. The field emission device according to claim 1, wherein the emission properties of the cold cathode devices are changed by varying a radius of curvature of a tip of one or more emitters in the cold cathode device.

4. The field emission device according to claim 1, wherein the emission properties of the cold cathode devices are changed by varying a work function or resistance value of one or more emitters in the cold cathode devices.

5. The field emission device according to claim 1, wherein a cathode electrode is connected to each cold cathode device, in which a cathode electrode connected to one cold cathode device group is electrically separate from a cathode electrode connected to another cold cathode device group, and limiting resistance is connected to the cathode electrode and the emission property of the cold cathode device group is changed by varying a value of the limiting resistance.

6. The field emission device according to claim 1, wherein individual emitters of the plurality of cold cathode device groups are distributed at random.

7. The field emission device according to claim 1, wherein each of the plurality of cold cathode device groups is classified in plural regions so that emitted emissions beams are disposed symmetrically with respect to a point at a center of the field emission device.

8. The field emission device according to claim 1, wherein a cathode electrode is connected to each cold cathode device group and a current control device is connected to the cathode electrode.

9. A picture tube comprising the field emission device of claim 1, wherein each of the plurality of cold cathode device groups is classified in plural regions so as to cancel the distortion in a shape of a beam spot of an emitted emission beam.

10. The field emission device according to claim 1, further comprising:

a current control device that is connected to a cathode electrode, wherein by inputting a control signal into the current control device from the control member, the current flowing into the cathode electrode is adjusted.

11. The field emission device according to claim 1, wherein the cold cathode device includes an emitter.

12. An image display apparatus comprising the field emission device of claim 1.

13. A field emission device according to claim 1, wherein a first threshold voltage at which emission occurs of the cold cathode devices included in at least one of the cold cathode device groups is different from a second threshold voltage at which emission occurs of the cold cathode devices included in at least one of the other cold cathode device groups.

14. A field emission device according to claim 1, wherein the control member increases the voltage when an emission current decreases.

15. A method of operating a field emission device, the field emission device including a plurality of cold cathode device groups each comprising a plurality of cold cathode devices having substantiaUy equal emission properties, wherein the emission properties of the cold cathode devices included in one of the cold cathode device groups is different from the emission properties of the cold cathode devices included in another cold cathode device group, the method comprising:

applying a voltage to a lead electrode in the cold cathode devices;

increasing the voltage applied to the lead electrode with a control member to a predetermined voltage corresponding to the emission properties of one of the plurality of cold cathode device groups in order to select one of the cold cathode device groups for mainly performing emission.

16. The method of operating the field emission device according to claim 15, wherein the emission property of each cold cathode device is changed by variation in a diameter of an open part formed by the lead electrode.

17. The method of operating the field emission device according to claim 15, wherein the emission properties of the cold cathode devices are changed by variation in a radius of curvature of a tip of one or more emitters in the cold cathode devices.

18. The method of operating the field emission device according to claim 15, wherein the emission properties of the cold cathode devices are changed by variation in a work function or resistance value of one or more emitters in the cold cathode devices.

19. The method of operating the field emission device according to claim 15, wherein a cathode electrode is connected to each cold cathode device, in which a cathode electrode connected to one cold cathode device group is electrically separate from a cathode electrode connected to another cold cathode device group, and limiting resistance is connected to the cathode electrode and the emission property of the cold cathode device group is changed by varying a value of the limiting resistance.

20. The method of operating the field emission device according to claim 15, wherein a first threshold voltage at which emission occurs of the cold cathode devices included in at least one of the cold cathode device groups is different from a second threshold voltage at which emission occurs of the cold cathode devices included in at least one of the other cold cathode device groups.

21. The method of operating the field emission device according to claim 15, wherein the control member increases the voltage when an emission current decreases.

22. A field emission device comprising:

a plurality of cold cathode devices having emission properties that are different;

a lead electrode included in the cold cathode devices:

a power source that applies a voltage to the lead electrode included in the cold cathode device; and a control member that increases the voltage so as to maintain total emission current at a predetermined value or more.

23. The field emission device according to claim 22, further comprising:

a current control device that is connected to a cathode electrode, wherein by inputting a control signal into the current control device from the control member, the current flowing into the cathode electrode is adjusted.

24. The field emission device according to claim 22, wherein the cold cathode device includes an emitter.

25. An image display apparatus comprising the filed emission device of claim 22.

26. A field emission device according to claim 22, wherein the plurality of cold cathode devices include at least one cold cathode device having a first threshold voltage at which emission occurs and at least one cold cathode device having a second threshold voltage at which emission occurs, the first and second threshold voltages being different.

27. A field emission device according to claim 22, wherein the control member increases the voltage when the total emission current decreases below the predetermined value.

* * * * *